US008596516B2

(12) United States Patent
Dodson et al.

(10) Patent No.: US 8,596,516 B2
(45) Date of Patent: Dec. 3, 2013

(54) SECURE FOLDER WITH DOUBLE BINDER

(75) Inventors: Darryll Dodson, Minneapolis, MN (US); Duane Christensen, Hastings, MN (US)

(73) Assignee: Smead Manufacturing Company, Hastings, MN (US)

( * ) Notice: Subject to any disclaimer, the term of this patent is extended or adjusted under 35 U.S.C. 154(b) by 783 days.

(21) Appl. No.: 12/618,323

(22) Filed: Nov. 13, 2009

(65) Prior Publication Data

US 2010/0116873 A1 May 13, 2010

Related U.S. Application Data

(60) Provisional application No. 61/114,250, filed on Nov. 13, 2008.

(51) Int. Cl.
*B65D 37/00* (2006.01)

(52) U.S. Cl.
USPC ..... 229/67.4; 229/67.3; 229/67.1; 229/928

(58) Field of Classification Search
USPC ..... 229/67.1–67.4, 72, 928; 206/245, 425
See application file for complete search history.

(56) References Cited

U.S. PATENT DOCUMENTS

| | | | | | |
|---|---|---|---|---|---|
| 241,388 | A * | 5/1881 | Lord | 24/17 R |
| 554,574 | A * | 2/1896 | Bennett | 206/425 |
| 566,821 | A * | 9/1896 | Van Alstine | 206/425 |
| 585,397 | A * | 6/1897 | Ordway | 229/67.3 |
| 621,732 | A * | 3/1899 | Wyman | 190/16 |
| 754,048 | A * | 3/1904 | Bushnell | 229/67.3 |
| 1,649,263 | A * | 11/1927 | Skelton | 229/67.4 |
| 3,312,384 | A * | 4/1967 | Heynemann | 383/13 |
| 4,112,991 | A * | 9/1978 | Barbaresi | 150/104 |
| 4,127,155 | A * | 11/1978 | Hydorn | 383/26 |
| 6,669,080 | B2 * | 12/2003 | Ong | 229/67.3 |
| 6,672,439 | B2 * | 1/2004 | Platte, III | 190/103 |
| 6,905,064 | B1 * | 6/2005 | Ong | 229/67.4 |
| 8,038,052 | B2 * | 10/2011 | Huang | 229/67.3 |
| 2003/0183679 | A1 * | 10/2003 | Ong | 229/67.3 |
| 2006/0108403 | A1 * | 5/2006 | Ho | 229/67.3 |
| 2007/0194090 | A1 * | 8/2007 | Chou | 229/67.3 |
| 2007/0290024 | A1 * | 12/2007 | Bullock | 229/67.1 |
| 2011/0272456 | A1 * | 11/2011 | Nething | 229/67.1 |
| 2012/0067942 | A1 * | 3/2012 | Quehl | 229/67.4 |

* cited by examiner

*Primary Examiner* — Jes F. Pascua
*Assistant Examiner* — Peter Helvey
(74) *Attorney, Agent, or Firm* — Altera Law Group, LLC

(57) ABSTRACT

A folder provides easy access to its contents, is lockable, and keeps its locking mechanism out of the way when not in use. The folder has fold lines partway down on the front and back faces, so that the user has easy access to the folder contents. There is a gusset on the bottom edge and on the side edges from the bottom to the fold lines. The folder has an elastic member that is configured to act as a locking mechanism. In the locked position, the elastic member extends over the top edge of the folder, thereby preventing the front and back faces from being folded down and additionally preventing the folder's contents from escaping along the top edge. In the unlocked position, the elastic member extends over the side edges of the folder, and the user may optionally fold down the front and/or back faces and may access the contents through the top edge of the folder. The user can easily move the elastic member from a side edge to the top edge and back, to lock and unlock the folder. In both locked and unlocked positions, the elastic member lies flush along the exterior of the folder and does not dangle freely.

12 Claims, 4 Drawing Sheets

SECURE FOLDER WITH DOUBLE BINDER

CROSS-REFERENCE TO RELATED APPLICATION

This application claims the benefit of U.S. Provisional Application No. 61/114,250 filed 13 Nov. 2008, which hereby is incorporated herein by reference in its entirety.

BACKGROUND OF THE INVENTION

1. Field of the Invention

The present invention is directed to securable file folders.

2. Description of the Related Art

File folders are commonly used in office settings.

One type of folder is commonly known as an easy-access top tab file pocket. The folder has a gusset on its bottom and portions of its sides, which extend from the bottom to within about 7 cm from its top edge. The top of the folder is open. The front of the folder has a fold line close to the top of the gusset, so that the front may be folded down and the user may have easy access to the folder contents.

There are drawbacks to the easy-access folder described above. Although the folder is enclosed on the bottom and on most of the sides, the top of the folder is still open. If the folder is handled carelessly, the contents may escape, which is undesirable.

Another type of folder has a lock on its top edge, which can contain the folder contents if the folder is handled carelessly. Such a lockable folder is commonly known as an expanding wallet with an elastic cord. This folder has a gusset on its bottom and its complete sides, which extends to the top of the folder. The front of the folder is generally featureless. The back of the folder extends past the top edge of the folder and includes several fold lines, so that the folder back may be folded over the top of the folder and extend partway over the top portion of the front edge. The folded-over portion includes an eyelet, through which a loop of elastic material extends. The loop may be extended over the entire folder, along its front and back surfaces, generally centered between its left and right edges. When extended over the entire folder, the elastic loop locks the folder and keeps its contents intact, even when the folder is handled carelessly.

Despite the locking feature, the expanding wallet with elastic cord has drawbacks as well. In particular, when the folder is open, or unlocked, there is a large elastic loop that dangles from the folded-over portion of the back edge. This dangling loop is unwieldy, and is a nuisance.

Accordingly, there exists a need for a folder that provides easy access to its contents, is lockable, and keeps its locking mechanism out of the way when not in use.

BRIEF SUMMARY OF THE INVENTION

An embodiment is a folder (10), comprising: a first face (20) having a first outside wall (21), a first inside wall (22), a first top edge (25), a first bottom edge (28), a pair of first side edges (26, 27) and a pair of first apertures (23A, 23B) spaced apart from the first top edge (25) and first side edges (26, 27); a second face (30) having a second outside wall (31), a second inside wall (32), a second top edge (35), a second bottom edge (38), a pair of second side edges (36, 37) and a pair of second apertures (33A, 33B) spaced apart from the second top edge (35) and second side edges (36, 37); a gusset (40) joining the first and second faces (20, 30) along at least part of the first and second side edges (26, 36; 27, 37) and the first and second bottom edges (28, 38); and an elastic member/thread/cord/lace/loop (50) extending: from the first inside wall (22), through one of the first apertures (23A) to the first outside wall (21), along the first outside wall (21) to an edge (25, 26, 27) of the first outside wall (21), to an edge (35, 36, 37) of the second outside wall (31), along the second outside wall (31), through one of the second apertures (33A) to the second inside wall (32), along the second inside wall (32), through the other of the second apertures (33B) to the second outside wall (31), along the second outside wall (31) to an edge (35, 36, 37) of the second outside wall (31), to an edge (25, 26, 27) of the first outside wall (21), along the first outside wall (21), and through the other of the first apertures (23B) to the first inside wall (22).

Another embodiment is a folder (10) for holding office-sized paper (80), comprising: a first face (20); a second face (30) generally parallel to and longitudinally separated from the first face (20); an expandable gusset (40) connecting the first and second faces (20, 30) on their respective bottom edges (28, 38) and on at least a portion of both of their side edges (26, 27; 36, 37); an elastic member (50) movable between a locked position (60) and an unlocked position (70), the locked position (60) comprising: a locked position path from an aperture (23A) in the first face (20), on an outer side (21) of the first face (20), to the top edge (25) of the first face (20), to the top edge (35) of the second face (30), on an outer side (31) of the second face (30), to an aperture (33A) in the second face (30); the unlocked position (70) comprising: an unlocked position path from the aperture (23A) in the first face (20), on the outer side (21) of the first face (20), to one of the side edges (26) of the first face (20), to the corresponding side edge (36) of the second face (30), on the outer side (31) of the second face (30), to the aperture (33A) in the second face (30); a first fold (24) disposed on the first face (20) parallel to and separated from the top edge (25) of the first face (20), between the top edge (25) of the first face and the aperture (23A) in the first face (20); and a second fold (34) disposed on the second face (30) parallel to and separated from the top edge (35) of the second face (30), between the top edge (35) of the second face and the aperture (33A) in the second face (30). The first and second faces (20, 30) may be folded along the first and second folds (24, 34), respectively, when the elastic member (50) is in the unlocked position (70). The first and second faces (20, 30) are prevented by the elastic member (50) from folding along the first and second folds (24, 34), respectively, when the elastic member (50) is in the locked position (60).

DETAILED DESCRIPTION OF THE INVENTION

A folder is disclosed that provides easy access to its contents, is lockable, and keeps its locking mechanism out of the way when not in use. The folder has fold lines partway down on the front and back faces, so that the user has easy access to the folder contents. There is a gusset on the bottom edge and on the side edges from the bottom to the fold lines. The folder has an elastic member that is configured to act as a locking mechanism. In the locked position, the elastic member extends over the top edge of the folder, thereby preventing the front and back faces from being folded down and additionally preventing the folder's contents from escaping along the top edge. In the unlocked position, the elastic member extends over the side edges of the folder, and the user may optionally fold down the front and/or back faces and may access the contents through the top edge of the folder. The user can easily move the elastic member from a side edge to the top edge and back, to lock and unlock the folder. In both locked and unlocked positions, the elastic member lies flush along the exterior of the folder and does not dangle freely.

The above paragraph is merely a summary, and should not be considered limiting in any way. A more detailed description of the folder follows below.

Figure 1:
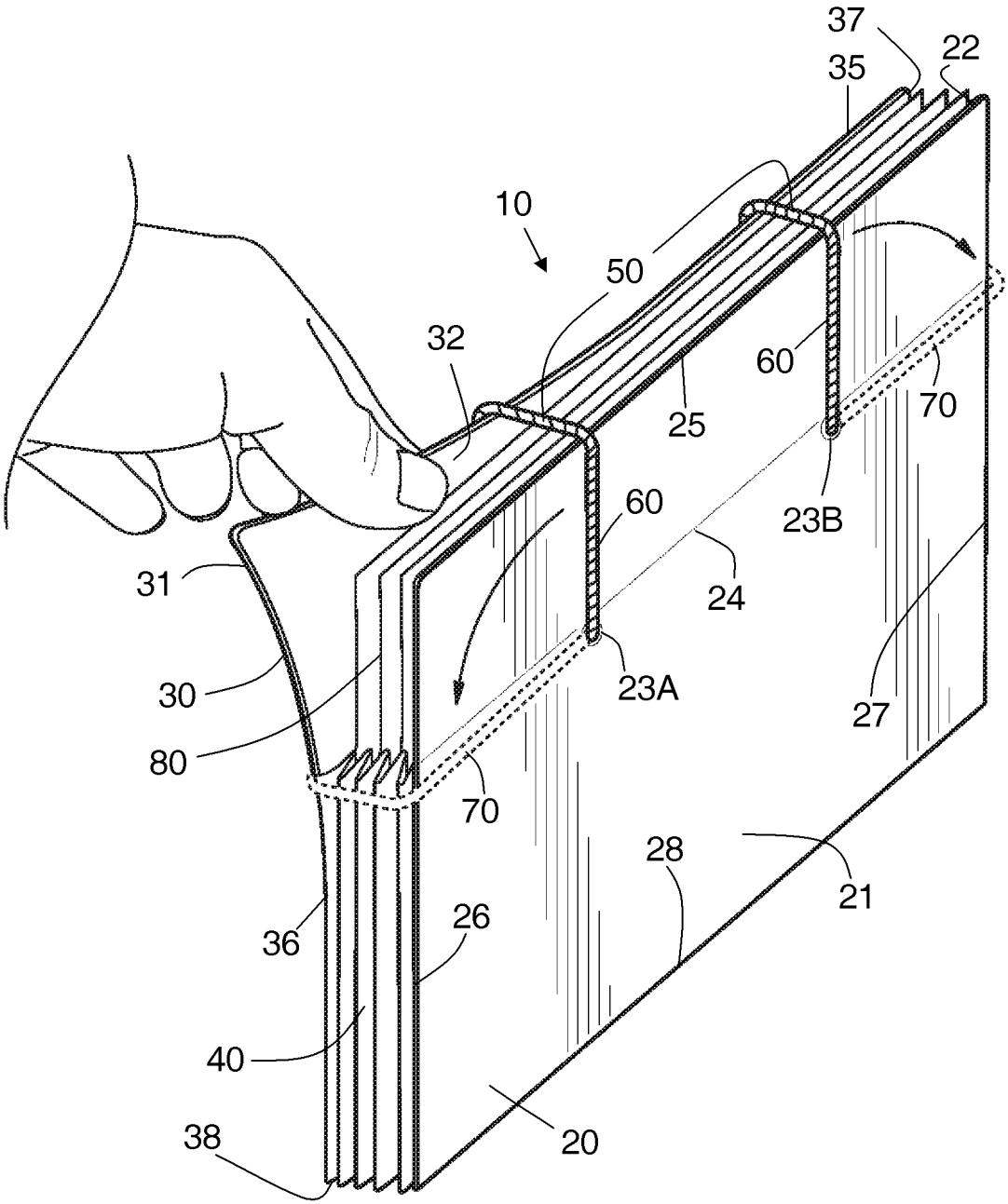
FIG. 1 is a plan drawing of a folder in the locked position having a single elastic member.
Figure 2:
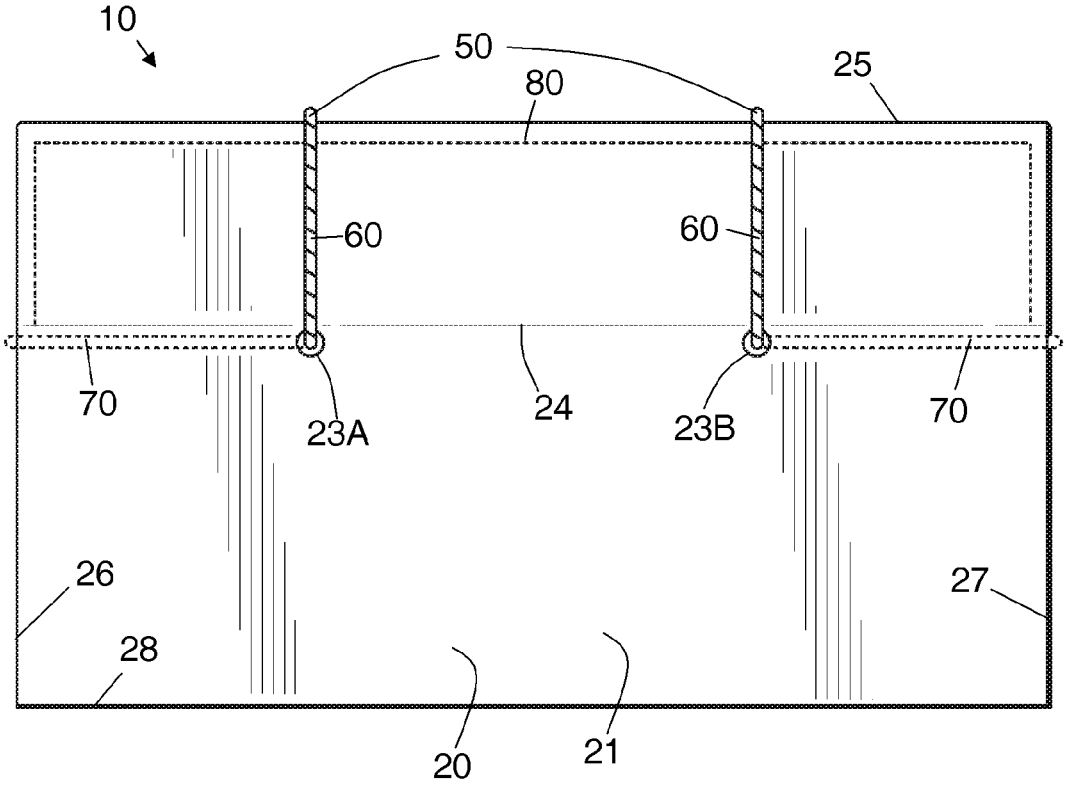
FIG. 2 is a front-view drawing of the folder of FIG. 1, also in the locked position.
Figure 3:
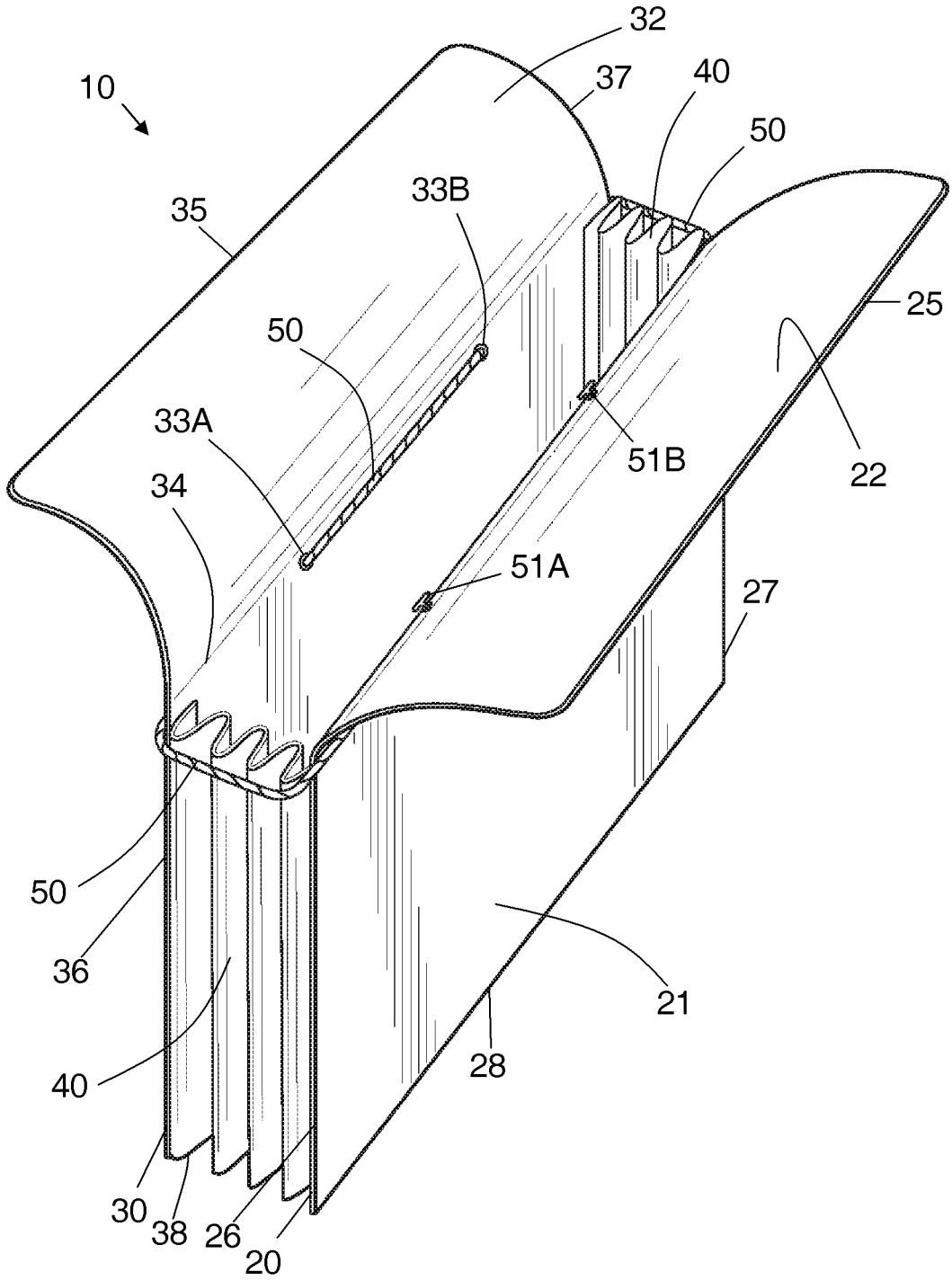
FIG. 3 is a plan drawing of the folder of FIGS. 1 and 2, in the unlocked position.

FIG. 1 is a plan drawing of a folder 10 in the locked position. FIG. 2 is a front-view drawing of the folder 10 of FIG. 1, also in the locked position. FIG. 3 is a plan drawing of the folder 10 of FIGS. 1 and 2, in the unlocked position and with the contents removed. All three figures are addressed simultaneously by the description below.

The folder 10 may be made from paper, cardboard and/or plastic, which may optionally be laminated and/or manufactured in layers. Elements may be attached to each other by adhesive along a shared seam, although any suitable attachment device may also be used. Two or more elements may also be made integrally with each other.

The folder 10 includes a front face 20 and a back face (or rear face) 30. The two faces include some similar elements, all of which are numbered with a "2x" for the front face and a "3x" for the rear face. The following description is of the front face 20, with the understanding that the rear face 30 may be similar in construction and in use.

The front face 20 has an outside wall 21, facing outward in the folder 20, and an inside wall 22 on the side opposite the outside wall 21, facing the contents of the folder 20. The outside wall 21 may optionally have a particular color and/or design, which may correspond to an indexing scheme, or may simply be decorative.

The front face 20 may be rectangular in shape, and sized larger than an office-sized sheet of paper 80. Typical office-sized paper includes sizes of 8.5 inches by 11 inches ("letter"), 8.5 inches by 14 inches ("legal"), and 210 mm by 297 mm ("A4"), although any suitable size may be used. The front face has a top edge 25, side edges 26 and 27, and a bottom edge 28. The top and bottom edges may be separated by more than 8.5 inches, 210 mm, or any other suitable dimension. Likewise, the side edges may be separated by more than 11 inches, 297 mm, or any other suitable dimension.

Alternatively, any of the edges of the front face 20 may include one or more optional tabs and/or recesses. Even with the tabs and/or recesses, the front face 20 may be considered to be generally rectangular, and such tabs and/or recess may be ignored for the purposes of this document.

The front face 20 includes a fold line 24, which is spaced apart from the top edge 25 of the front face 20, and may be generally parallel to the top edge 25. When the folder 10 is opened, the front face 20 may be folded along the fold line 24, which allows easy access to the contents of the folder 10. The top portion of the front face 20 (above the fold line 24) is folded towards the user, while the bottom portion of the front face 20 (below the fold line 24) remains fixed.

The front face 20 includes one or more holes, eyelets, or apertures 23A, 23B. These holes 23 allow one or more elastic members to pass from the outside wall 21 to the inside wall 22, or from the inside wall 22 to the outside wall 21. In some applications, the holes 23 are adjacent to the fold line 24, and are on the bottom side of the fold line 24. In some applications, the holes 23 are symmetrically placed from the side edges 26 and 27 of the front face 20, although they may optionally have an asymmetric placement. In some applications, the holes 23 are all the same distance from the top edge 25 of the front face 20, although they may optionally have different distances from the top edge 25. Each hole 23 may include an optional plastic or metal lining or eyelet, which may improve its strength. On such asymmetric placement would be to have the holes 23A/B located closer to the top edge of the face than the side edge. For example, FIG. 2 could be modified to move holes 23A and B 5 cm (or other distance) closer to the top edge than toward the side edge, or the reverse. This would maximize the binding capability of the elastic member (for pockets which are very full of papers), but still be capable of being stored in their side position 70.

In some applications, the rear face 30 may be similar in construction and function to the front face 20, although there may be optional differences in size, shape, texture, and/or appearance. The rear face 30 also includes an outer or outside wall 31, an inner or inside wall 32, apertures 33A and 33B, a fold line 34, a top edge 35, side edges 36 and 37, and a bottom edge 38.

The front and rear faces 20 and 30 are connected by an expandable gusset or bridging member 40. Such a gusset 40 may have an accordion-like appearance along a particular direction, as shown, but may be of any material expandable or not, and may be expanded to accommodate a large number of documents in the folder 10. The gusset may connect the front and rear faces 20, 30 entirely along their bottom edges 21, 31, and along a portion of their side edges 26, 36; 27, 37. In some applications, the gusset 40 may extend from the bottom edges 28, 38, roughly to the fold lines 24, 34. In an alternate embodiment, not shown, the gusset reaches generally to the top, or near the top of sidewalls 21/22. The side edges 26, 36; 27, 37 may be unconnected above the fold lines 24, 34. It should also be noted that the folder may not have traditional "gussets" at all, but we will still use the term "gusset" to include them. For example, a web can be provide to link the front and back walls. It is also possible that there be no sidewalls at all. Further, the band 50 concept disclosure herein may be applied in non-file folder configurations. It is only necessary that the item have a front and back wall (whether or not planar) and a need to limit items contained therein from falling out of the top.

There is an elastic band or elastic member 50 that is woven through the holes 23, 33 on the front and back faces 20, 30 of the folder 10. The material of the elastic member 50 may be similar or identical to that used in the expanding wallet with elastic cord described above. Note that the elastic member must be read broadly and need not be elastic along its entire length. It may have an elastic portion or it may have an elastic system at one or more of its end, such as a take up spool.

The ends of the elastic member 50 include terminators 51A, 51B. Each terminator 51A, 51B may extend laterally beyond an edge of the respective hole 23A, 23B in the first face 20. For example, each terminator 51 may be simply a laterally extending portion, made from plastic or any other suitable material. During assembly of the folder 10, the terminator 51 may be bent to lie parallel to the elastic member 50, then inserted through the hole 23. When released, the terminator 51 springs back to its relaxed shape and assumes its generally lateral orientation. The terminator 51 is thus prevented from returning through the hole 23. A terminator only needs to have a larger cross sectional area than the opening in at least one dimension and can be a simple as a knot The single elastic member 50 traces out a path through the folder 10 as follows.

The elastic member 50 has a terminator 51A that anchors the end of the elastic member on the inside wall 22 of the front face 20. The elastic member 50 then passes through the holes 23A to the outside wall 21 of the front face, travels along the outside wall 21 to either the side edge 26 (unlocked) or the top edge 25 (locked) of the front face 20, passes longitudinally to either the side edge 36 (unlocked) or the top edge 35 (locked) of the rear face 30, and travels along the outside wall 31 of the rear face 30 to the hole 33A. The elastic member 50 then passes through the hole 33A, travels along the inside wall 32 of the rear face 30 to the hole 33B, and passes through the hole 33B to the outside wall 31 of the rear face 30. The elastic member 50 then travels along the outside wall 31 to either the side edge 37 (unlocked) or the top edge 35 (locked), passes longitudinally to either the side edge 27 (unlocked) or the top edge 25 (locked) of the front face, travels along the outside wall 21 of the front face 20 to the hole 23B. The elastic member 50 passes through the hole 23B to the inside wall 22 of the front face 20, and ends at a terminator 51B. Note that from the outside of the folder, it is difficult to tell whether the terminators are on the front or rear faces of the folder. For this reason, the roles of the front and rear surfaces may be reversed, for the purposes of anchoring the elastic member 50.

Figure 4:
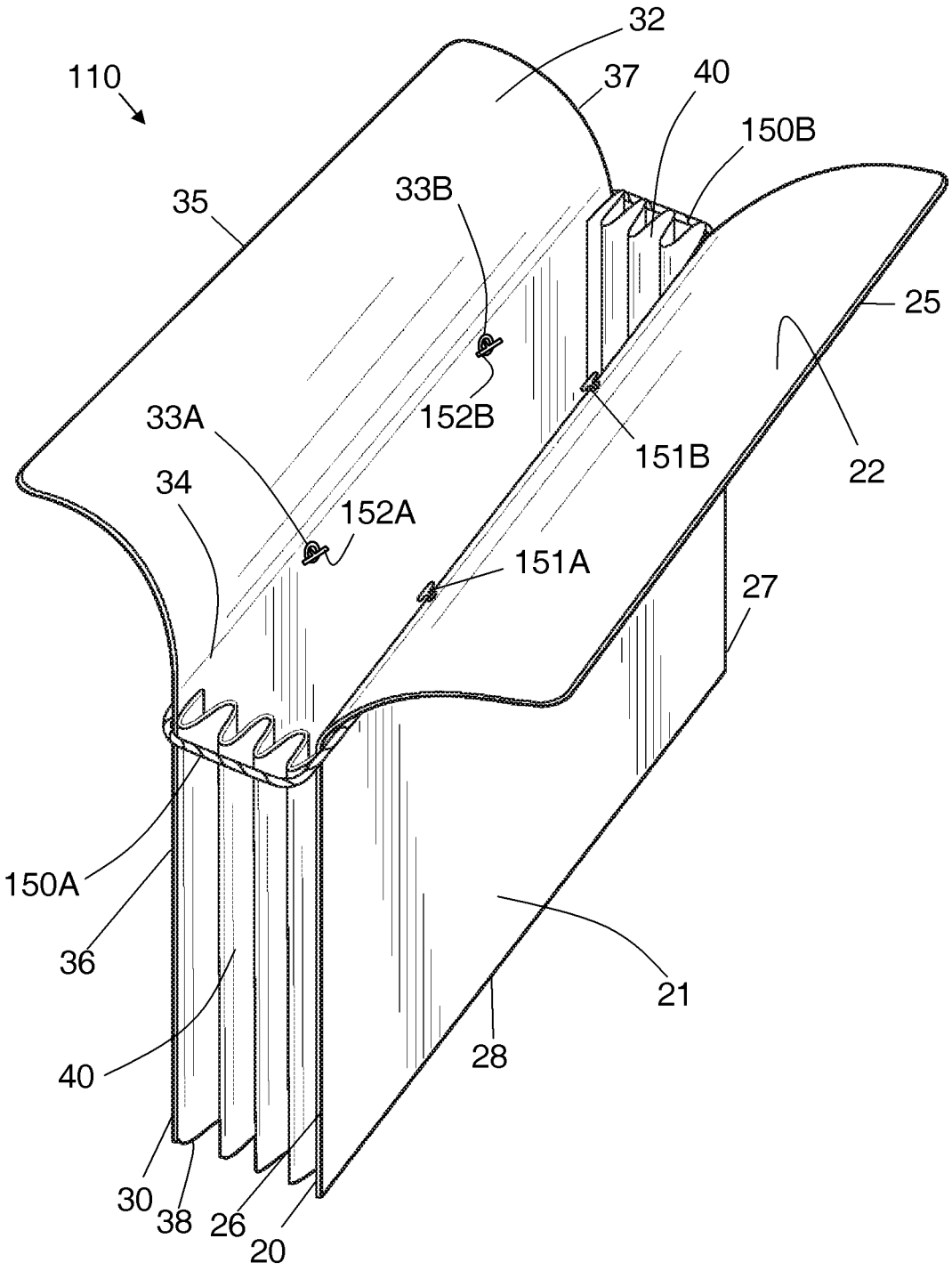
FIG. 4 is a plan drawing of a folder in the unlocked position having a pair of elastic members.

Alternatively, there may be more than one elastic member 50 used in the folder 10. For instance, FIG. 4 shows a folder 110 having a pair of elastic members 150A and 150B, with one being used for the "left" pair of holes 23A, 33A, and the other being used for the "right" pair of holes 23B, 33B. In this case, the elastic members 150A and 150B do not pass between adjacent holes 33A and 33B on the rear face 30. The elastic member 150A has terminators 151A, 152A at respective holes 23A, 33A, and elastic member 150B has terminators 151B, 152B at respective holes 23B, 33B. Each elastic member 150 starts at an inside wall, passes through a hole to an outside wall, travels along the outside wall to a top edge (closed position) or a side edge (open position), travels longitudinally to the opposing face of the folder, travels along the outside wall to a hole, passes through the hole, and ends at the inside wall. This alternative embodiment requires two separate elastic members but can provide a higher biasing force and is likely to stay in position better because there is not elastic correlation between the separate portions The description of the invention and its applications as set forth herein is illustrative and is not intended to limit the scope of the invention. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

The method of manufacture has already been described but is reiterated as follows: a method of creating a closure for closing the top of an open ended folder having a pair of spaced apart sidewalls, a gusset connecting the sidewalls along their sides and bottom to form a pocket, the sidewalls each having a pair of spaced apart apertures for receive an elastic member having first and second ends, comprising the steps of:

a. Affixing a terminator to one end of the member,
b. Lacing the member through one aperture on one sidewall from in inside thereof to the outside, then
c. Lacing the member along the outside of said one sidewall to the outside of the other sidewall and
d. Lacing the member through one of the apertures in said other sidewall through an aperture from the outside inward and
e. Lacing the member from one aperture in that other sidewall through the other aperture in that sidewall out the second aperture, and
f. Lacing the member to the outside of said one sidewall and in through the remaining unused aperture and
g. Affixing a terminator to send member after it has pass through said remaining aperture;

thereby forming an elastic lace system to retain items in the folder.

It is possible to modify this method to use two separate laces which connect like apertures on unlike sidewalls for example so that a lace connects apertures 23A to 33A (and likewise 23B and 33B) from outside the sidewalls and each lace is terminated on the side of the sidewall. In such case there will be no lace connecting 33A and B as unnecessary. This structure and method is not preferred because it requires more terminators and provides less elasticity due to the shorter length of lace.

We claim:

1. A document folder comprising:

a first face having a first outside wall a first inside wall, a first top edge, a first bottom edge, a pair of first side edges and a pair of first apertures spaced apart from the first top edge and first side edges;

a second face having a second outside wall a second inside wall, a second top edge a second bottom edge, a pair of second side edges and a pair of second apertures spaced apart from the second top edge and second side edges;

a gusset joining the first and second faces along at least part of the first and second side edges and the first and second bottom edges; and an elastic member extending:

from the first inside wall, through one of the first apertures to the first outside wall, along the first outside wall to an edge of the first outside wall, to an edge of the second outside wall, along the second outside wall, through one of the second apertures to the second inside wall, along the second inside wall, through the other of the second apertures to the second outside wall, along the second outside wall to an edge of the second outside wall, to an edge of the first outside wall, along the first outside wall, through the other of the first apertures to the first inside wall and wherein the location of pairs of first and second apertures are asymmetric with respect to first and second top edges of the first and second faces, and the first and second side edges of the first and second faces wherein said first and second apertures are closer to said first and second top edges than they are to said first and second side edges, so that tension on said elastic member is less when the member is positioned over the top edges than when it is positioned over the side edges.

2. The folder of claim 1, wherein the elastic member is positionable to any of:

a closed position extending across the first and second top edges of the first and second faces, respectively; and an open position extending across the first and second side edges of the first and second faces, respectively.

3. The folder of claim 1, wherein each end of the elastic member includes a terminator that extends beyond an edge of the respective first aperture in the first face.

4. The folder of claim 1, wherein the first face includes a first fold line between the first top edge and the pair of first apertures; and wherein the second face includes a second fold line between the second top edge and the pair of second apertures.

5. The folder of claim 4, wherein the first and second fold lines are generally parallel to the first and second top edges, respectively.

6. The folder of claim 4, wherein the gusset joins the first and second faces along the first and second side edges from the first and second fold lines to the first and second bottom edges, and along the entire first and second bottom edges.

7. The folder of claim 4, for receiving materials of predetermined length and width and the walls have top and side edges, wherein the first and second top edges are separated from the first and second bottom edges, respectively, by at least by the width of materials to be inserted into the folder;

wherein the first and second fold lines are separated from the first and second bottom edges, respectively, by less than the width of materials to be inserted into the folder;

wherein the first side edges are separated from each other by at least length of the materials to be inserted into the folder; and wherein the second side edges are separated from each other by at least the length of materials to be inserted into the folder.

8. The folder of claim 1, wherein the gusset is expandable.

9. A folder for holding office-sized paper, comprising:

a first face;

a second face generally parallel to and longitudinally separated from the first face;

an expandable gusset connecting the first and second faces on their respective bottom edges and on at least a portion of both of their side edges;

an elastic member movable between a locked position and an unlocked position, the locked position comprising:

a locked position path from an aperture in the first face, on an outer side of the first face, to the top edge of the first face, to the top edge of the second face, on an outer side of the second face, to an aperture in the second face;

the unlocked position comprising:

an unlocked position path from the aperture in the first face, on the outer side of the first face, to one of the side edges of the first face, to the corresponding side edge of the second face, on the outer side of the second face, to the aperture in the second face;

a first fold disposed on the first face parallel to and separated from the top edge of the first face, between the top edge of the first face and the aperture in the first face; and a second fold disposed on the second face parallel to and separated from the top edge of the second face, between the top edge of the second face and the aperture in the second face;

wherein the first and second faces may be folded along the first and second folds, respectively, when the elastic member is in the unlocked position; and wherein the first and second faces are prevented by the elastic member from folding along the first and second folds, respectively, when the elastic member is in the locked position and wherein the pairs of first and second apertures are asymmetrically located such that they are closer to the top edges than the side edges.

10. The folder of claim 9, wherein the locked position path further extends from the aperture in the second face, on an inner side of the second face, through a second aperture in the second face, on the outer side of the second face to the top edge of the second face, to the top edge of the first face, on an outer side of the first face, through a second aperture in the first face.

11. The folder of claim 9, wherein the unlocked position path further extends from the aperture in the second face, on an inner side of the second face, through a second aperture in the second face, on the outer side of the second face to the other of the side edges of the second face, to the corresponding side edge of the first face, on an outer side of the first face, through a second aperture in the first face.

12. A folder comprising:

a first face having a first outside wall a first inside wall, a first top edge, a first bottom edge, a pair of first side edges and a pair of first apertures spaced apart from the first top edge and first side edges;

a second face having a second outside wall a second inside wall, a second top edge a second bottom edge, a pair of second side edges and a pair of second apertures spaced apart from the second top edge and second side edges;

a gusset joining the first and second faces along at least part of the first and second side edges and the first and second bottom edges; and an elastic member extending:

from the first inside wall, through one of the first apertures to the first outside wall, along the first outside wall to an edge of the first outside wall, to an edge of the second outside wall, along the second outside wall, through one of the second apertures to the second inside wall, along the second inside wall, through the other of the second apertures to the second outside wall, along the second outside wall to an edge of the second outside wall, to an edge of the first outside wall, along the first outside wall, through the other of the first apertures to the first inside wall and wherein said first and second apertures are closer to said first and second top edges than they are to said first and second side edges, so that tension on said elastic member is less when the member is positioned over the top edges than when it is positioned over the side edges further comprising a second elastic member movable between a second locked position and a second unlocked position, the second locked position comprising:

a second locked position path from a second aperture in the first face, on the outer side of the first face, to the top edge of the first face, to the top edge of the second face, on the outer side of the second face, to a second aperture in the second face; and the second unlocked position comprising:

a second unlocked position path from the second aperture in the first face, on the outer side of the first face, to the other of the side edges of the first face, to the corresponding side edge of the second face, on the outer side of the second face, to the second aperture in the second face.

* * * * *